United States Patent [19]

Berrey et al.

[11] Patent Number: 4,468,142

[45] Date of Patent: Aug. 28, 1984

[54] PINT WIRE ACTUATOR

[75] Inventors: Harry R. Berrey, Waynesboro; Paul W. Caulier, Greenwood, both of Va.

[73] Assignee: Genicom Corporation, Waynesboro, Va.

[21] Appl. No.: 440,811

[22] Filed: Nov. 12, 1982

[51] Int. Cl.[3] ..... B41J 3/12

[52] U.S. Cl. ..... 400/124; 101/93.05; 335/261

[58] Field of Search ..... 400/124, 121; 101/93.05, 93.04, 93.48; 335/261

[56] References Cited

U.S. PATENT DOCUMENTS

| | | | |
|---|---|---|---|
| 3,219,853 | 11/1965 | Schreiber | 335/261 X |
| 3,755,700 | 8/1973 | Buschmann et al. | 310/30 |
| 3,897,865 | 8/1975 | Darwin et al. | 400/124 |
| 3,946,851 | 3/1976 | Cestrieres et al. | 400/124 |
| 3,994,382 | 11/1976 | McIntosh | 400/124 |
| 4,200,401 | 4/1980 | Roy et al. | 400/124 |
| 4,211,496 | 7/1980 | Naylor | 400/124 |
| 4,218,148 | 8/1980 | Matschke | 400/124 |
| 4,226,545 | 10/1980 | Brandenburg et al. | 400/124 |
| 4,339,109 | 7/1982 | Kawata et al. | 335/261 X |

FOREIGN PATENT DOCUMENTS

| | | | |
|---|---|---|---|
| 2359357 | 6/1975 | Fed. Rep. of Germany | 400/124 |

*Primary Examiner*—Paul T. Sewell

*Attorney, Agent, or Firm*—Cushman, Darby & Cushman

[57] ABSTRACT

A solenoid-type print wire actuator includes a unitary one-piece bobbin formed of a magnetically permeable material and having two axially spaced-apart annular grooves in the outer surface thereof. An electromagnetic coil is wound on the bobbin. A dumbbell-shaped armature is disposed coaxially within the bobbin and is connected to the print wire for axial movement thereof, the armature having two cylindrical piston portions respectively disposed adjacent to the bobbin grooves. The ends of the bobbin are respectively supported in bores in the leg portions of a U-shaped member, the leg portions being interconnected by another piece to form a frame of magnetically permeable material to define a flux path.

16 Claims, 5 Drawing Figures

FORCE VECTOR DIAGRAM

FM = MAGNETIC FORCE

FA = AXIAL COMPONENT

FR = RADIAL COMPONENT

PINT WIRE ACTUATOR

BACKGROUND OF THE INVENTION

The present invention relates generally to impact printing devices for dot matrix printers and, more particularly, to improved solenoid-type actuators for such printing devices.

A typical print head for a dot matrix-type printer has a plurality of print wires, each actuated by an individual print wire solenoid. This type of print wire solenoid actuator is disclosed, for example, in U.S. Pat. No. 3,755,700, issued Aug. 28, 1973. The solenoid actuator consists of a magnetically permeable cylinder which serves as a bobbin on which the electromagnetic coil is wound, as a guide for an armature which is disposed within the cylinder, and as part of the path for the magnetic flux. The cylinder is enclosed within a housing structure of magnetically permeable material which also forms a part of the magnetic circuit. The cylinder has an annular gap therein intermediate its ends, which may be formed by inclusion of a section of non-magnetic material, and which interrupts the magnetic circuit formed by the cylinder and the outer structure. The armature serves to complete the magnetic circuit past this gap.

The armature, which is connected to the print wire, moves axially of the cylinder between a normal rest position and a printing position. In its rest position, the armature, in the form of a piston, has its leading edge disposed at the cylinder gap and is so related thereto that there results a relatively long magnetic flux path at the leading edge of the armature. Thus, when the coil is energized, the axial component of the magnetic force exerted on the piston or armature moves it forwardly to its printing position which is toward an equilibrium position wherein the armature extends substantially equal distances forwardly and rearwardly of the cylinder gap so that the axial components of the magnetic force exerted thereon in the forward and rearward directions substantially balance each other and could be essentially zero. When the coil is de-energized, the armature is returned to its rest position (i.e. seated against a back step) under the action of a bias spring and the rebounding of the piston and wire mass from the target (i.e. the platen), ribbon and record medium.

Because the print head includes a plurality of print wires, each controlled by its own solenoid, and because the print wires must be closely grouped to print relatively small characters, it is essential that the size of the solenoid-type print wire actuators be minimized. Since the armature is the innermost component of the actuator assembly, the overall outer diameter of the actuator will be a function of the armature diameter. Thus, it is desirable to make the armature diameter as small as possible. However, it has been found that when the diameter of the armature of prior actuators is reduced, it results in a corresponding reduction in the drive force imparted to the print wire. The reduced drive force results in a reduced armature acceleration and reduced impact force when the wire hits the target. This reduced impact force is unacceptable, since it is not sufficient for clear printing.

Furthermore, the prior actuator solenoid is encased in a magnetic cylinder, the thickness of which serves to add to the overall size of the device. This serves further to increase the center-to-center distance of the print wires when the actuators are arranged in a linear array, or the size of the cluster when arranged in a circular or other non-linear array.

Additionally, the formation of the gap in the cylinder results in a multi-part construction of the cylinder, necessitating costly and complex manufacture.

SUMMARY OF THE INVENTION

The present invention provides an improved solenoid-type print wire actuator which avoids the disadvantages of prior actuators while affording additional structural and operating advantages.

It is a general object of this invention to provide a print wire actuator of the type set forth which achieves minimum overall size.

In connection with the foregoing object, it is another object of this invention to provide a print wire actuator of the type set forth which achieves minimum size without diminishing the impact force imparted to the print wire.

Still another object of this invention is the provision of a print wire actuator which is of simple and economical construction, utilizing a minimum number of parts.

These and other objects of the invention are attained by providing in a solenoid-type print wire actuator including an electromagnetic coil for moving the print wire axially of the coil, the improvement comprising: coil support means of magnetically permeable material including a cylindrical portion coaxial with the coil and having a plurality of axially spaced-apart control portions which are magnetically relatively impermeable when the coil is energized, and armature means disposed within the cylindrical portion and connected to the print wire for movement therewith axially of the cylindrical portion, the armature means including a plurality of axially spaced-apart piston portions of magnetically permeable material equal in number to and respectively disposed adjacent to the control portions, the piston portions cooperating with the coil support means to form a magnetic flux path past the control portions for moving the armature means and the print wire axially in response to energization of the coil.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
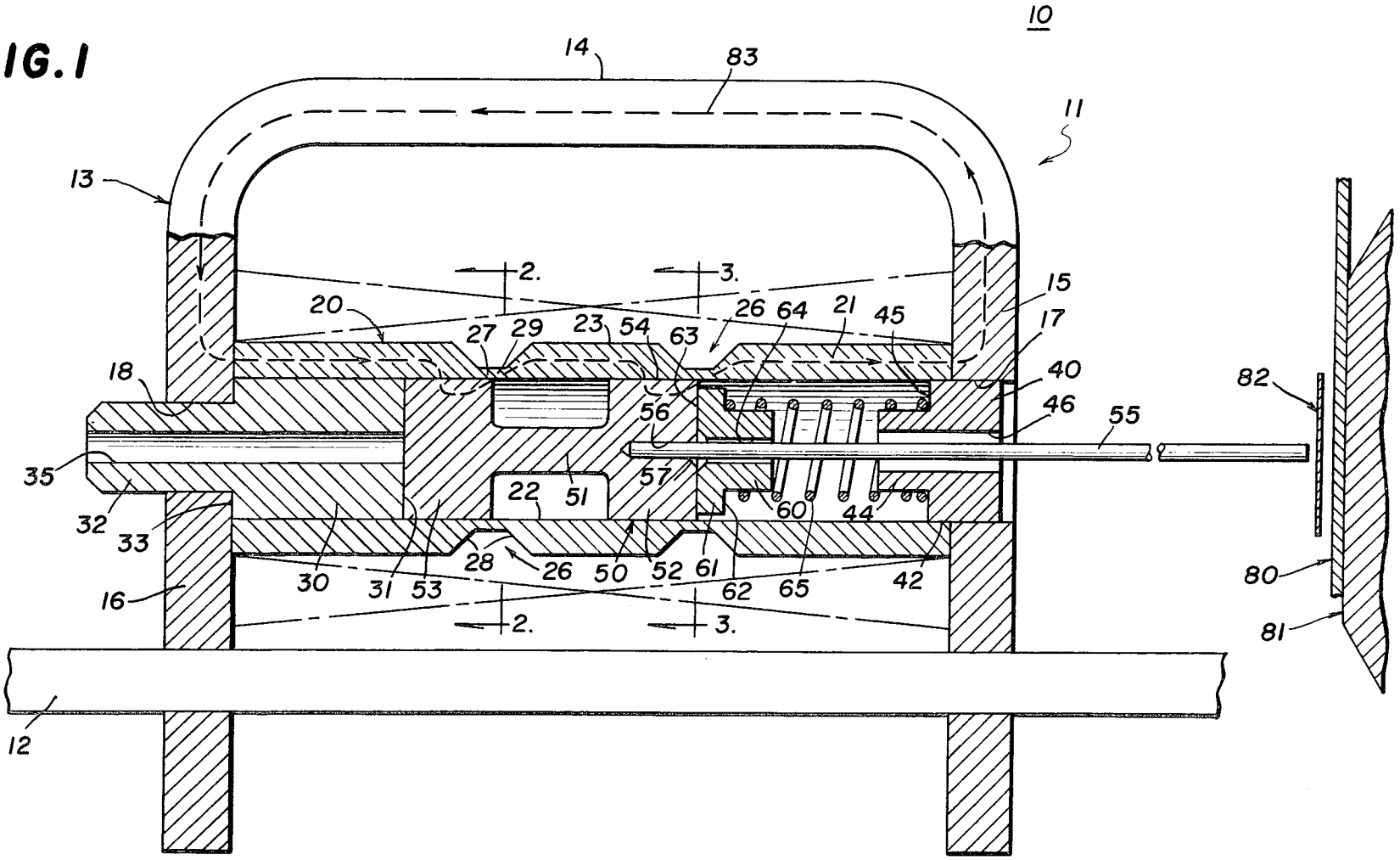
FIG. 1 is a fragmentary, side elevational view in partial vertical section illustrating a print wire actuator constructed in accordance with and embodying the features of the present invention.

There is illustrated in the drawings a print wire actuator of the solenoid type, generally designated by the numeral 10, for actuating a print wire 55 of a dot matrix impact printer. The actuator 10 includes a frame, generally designated by the numeral 11, of magnetically permeable material, the frame 11 including an elongated, flat base plate 12 and a generally U-shaped bracket 13. The bracket 13 has a generally flat, rectangular bight portion 14 integral at the ends thereof, respectively, with two substantially parallel rectangular leg portions 15 and 16. The leg portions 15 and 16 are disposed substantially normal to the bight portion 14 and to the base plate 12, and may have the distal ends thereof respectively received in complementary openings in the base plate 12. The leg portions 15 and 16 have respectively formed therethrough a relatively large diameter bore 17 and a relatively small diameter bore 18, the bores 17 and 18 being coaxial and having the axis thereof disposed substantially parallel to the base plate 12.

Figure 4:
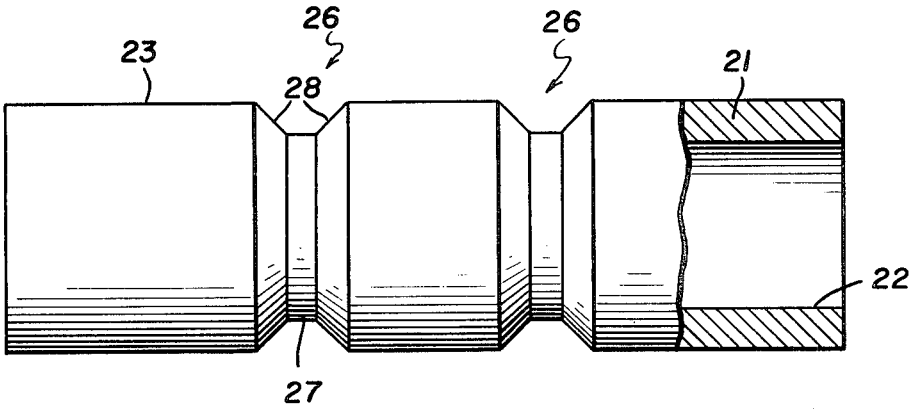
FIG. 4 is a side elevational view of the bobbin of the print wire actuator of FIG. 1, in partial vertical section.

The actuator 10 also includes a cylinder, generally designated in FIGS. 4 and 1 by the numeral 20, formed of a single piece of magnetically permeable material, and which has an elongated cylindrical body 21 having a cylindrical inner surface 22 and a cylindrical outer surface 23. Formed in the outer surface 23 of the cylindrical body 21 intermediate the ends thereof are two annular control grooves, each generally designated by the numeral 26, spaced apart a predetermined distance axially of the cylindrical body 21. Each of the control grooves 26 is generally channel-shaped in transverse cross section, having a cylindrical inner wall 27 and two frustoconical end walls 28, respectively connecting the edges of the inner wall 27 with the outer surface 23. The inner wall 27 is spaced a very slight distance from the inner surface 22 of the cylindrical body 24 in cooperation therewith to define therebetween a thin control annulus 29 acting as a magnetic flux control portion.

Figure 5:
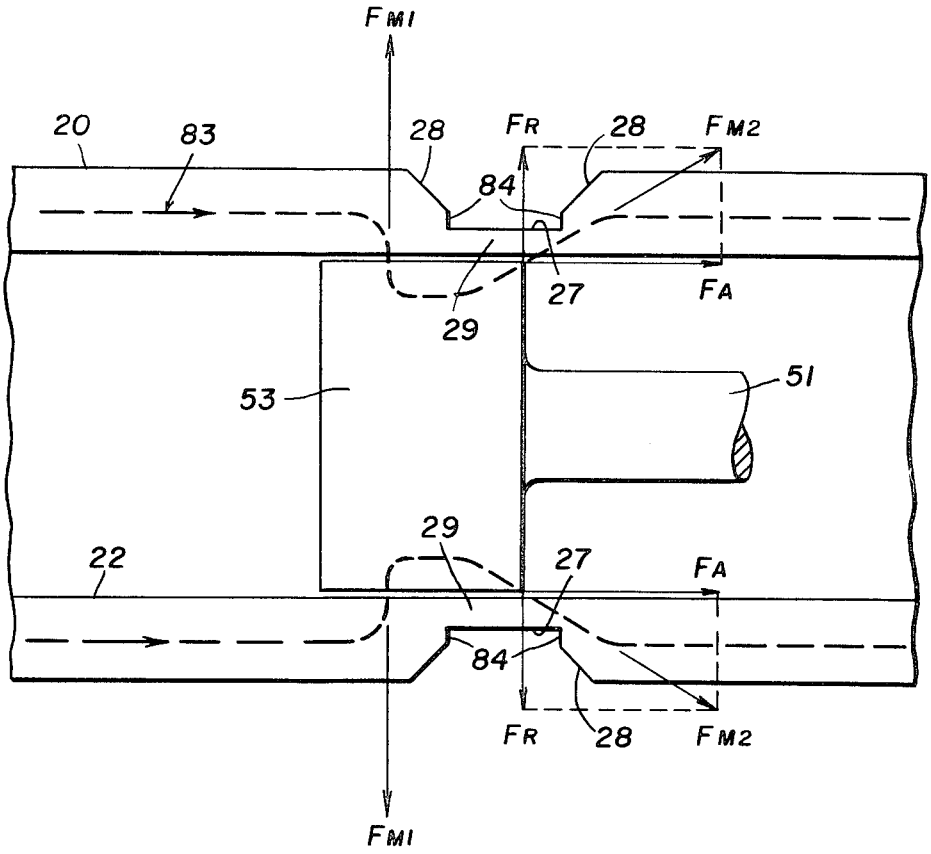
FIG. 5 is a combination schematic and force diagram useful in explaining the operation of the present invention.

Referring to FIG. 5 there is shown the resulting force vectors developed at one of the magnetic flux control portions of the actuator. The magnetic flux path 83 comprises serially the bracket 13, a left side portion of cylinder 20, the annulus 29, the air gap between the annulus 29 and the piston 53, the piston 53, the air gap again, and the saturated portion of the annulus and the right side portion of 20, and back to the bracket 13 through the path shown in FIG. 1. The force FM1 produced by the magnetic flux is radial around the circumference of the left hand portion of the piston 53 as represented by the vector FM1. These radial forces cancel out. The force FM2 produced by the magnetic flux at the right hand leading edge of the piston 53 has the direction shown by the vector FM2. This vector FM2 has a radial component $F_R$ similar to FM1 and an axial component $F_A$ which operates to drive the piston 53 to the right toward the desired target.

The actuator 10 also includes a cylindrical backstop 30 of non-magnetic material, having a circular end surface 31 at one end thereof and being provided at the other end thereof with an axially outwardly extending rear projection 32 which is part-cylindrical in shape, preferably being provided with flat sides and dimensioned to be fitted through the bore 18 in the leg portion 16. The projection 32 has a diameter less than that of the backstop 30 and cooperates therewith to define therebetween a generally annular shoulder 33. A bore 35 extends axially entirely through the backstop 30 and the projection 32. The backstop 30 is dimensioned to be fitted snugly within the cylinder 20 at one end thereof.

Disposed at the other end of the cylinder 20 is a cylindrical nozzle 40 of non-magnetic material, having a cylindrical outer surface 41 dimensioned to be received in the bore 17 in the leg portion 15 of the frame 11. The nozzle 40 has a stepped cylindrical surface 42 projecting from one end thereof and cooperating therewith to define therebetween an annular shoulder 43. A cylindrical rear projection 44 extends axially from the stepped cylindrical portion 43 and cooperates therewith to define therebetween an annular shoulder 45. A bore 46 extends axially all the way through the nozzle 40. The cylindrical portion 42 is dimensioned to be fitted snugly within the cylinder 20.

Figure 2:
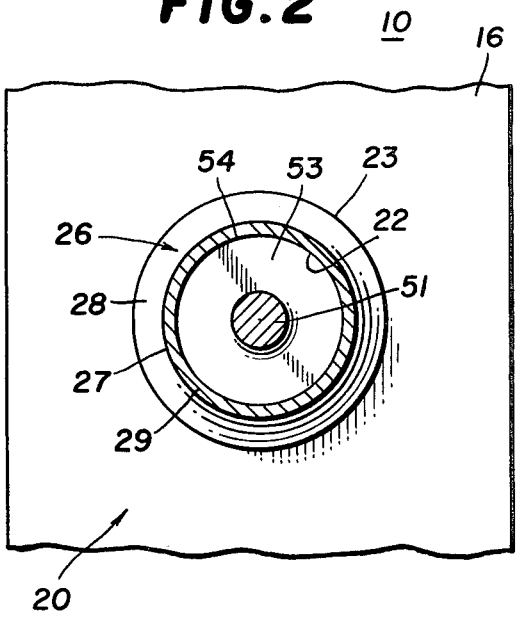
FIG. 2 is a fragmentary view in vertical section taken along the line 2—2 in FIG. 1.
Figure 3:
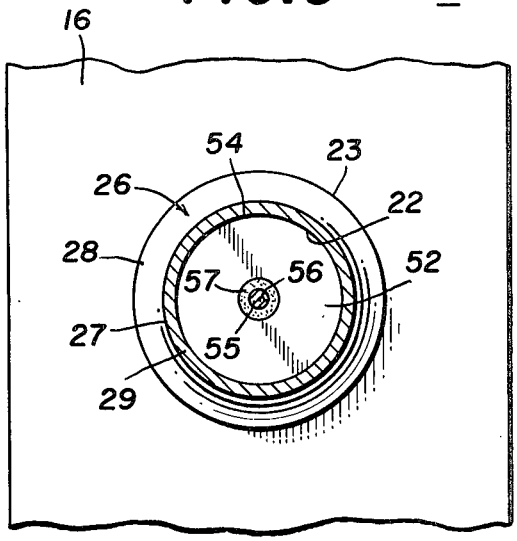
FIG. 3 is a fragmentary view in vertical section taken along the line 3—3 in FIG. 1.

The print wire actuator 10 also includes a cylindrical armature, generally designated by the numeral 50, which includes a cylindrical neck 51 having a diameter substantially less than that of the inner surface 22 of the cylinder 20, and integral at the opposite ends thereof, respectively, with two enlarged-diameter cylindrical piston portions 52 and 53 as shown in FIGS. 1, 2 and 3. Each of the portions 52 and 53 is provided with an outer cylindrical surface 54 which is dimensioned to fit slidably within the cylinder 20. The armature 50 is formed of a magnetically permeable material and is of integral one-piece construction, being of substantially uniform composition throughout. There is also provided an elongated print wire 55 which has one end thereof snugly received in a complementary axial bore 56 in the piston portion 52 of the armature 50, being secured in place by brazing, as at 57. Thus, the print wire 55 projects from one end of the armature 50 coaxially therewith, as illustrated in FIG. 1 and in a direction, when actuated, to print on a record medium 80, such as paper, positioned against a platen or striker bar 81 through an inked ribbon 82.

There is also provided a cylindrical spring seat 60 which has a diameter substantially the same as the diameter of the rear projection of the nozzle 40, the spring seat 60 being provided at one end thereof with an enlarged cylindrical flange 61, which cooperates with the spring seat 60 to define therebetween an annular shoulder 62. The other end of the cylindrical flange 61 has a circular end surface 63. An axial bore extends all the way through the spring seat 60 and the cylindrical flange 61. In use, the spring seat 60 receives the print wire 55 through the bore 64 thereof and has the end surface 63 thereof disposed against the piston portion 52 of the armature 50. A helical compression spring 65 is disposed in surrounding relationship with the spring seat 60 and the rear projection 44 of the nozzle 40, the ends of the spring 65 being seated respectively against the shoulder surface 62 of the spring seat 60 and the annular shoulder 45 of the nozzle 40, as is best illustrated in FIG. 1.

In one embodiment, a coil of electrical wire is wound on the cylinder 20, as indicated at 70 of FIG. 1, to form an electromagnet coil in a well known manner. In assembly of the print wire actuator 10, the cylinder 20, with the coil 70 wound thereon, receives the backstop 30 thereinto. The cylinder 20 is then mounted between the leg portions 15 and 16 of the frame 11 until it is coaxial with the bores 17 and 18. The backstop 30 is then pushed rearwardly (to the left, as viewed in FIG. 1), inserting the rear projection 32 through the bore 18 in the leg portion 16, until the annular shoulder 33 bears against the inner surface of the leg portion 16. The flat sides of the rear projection 32 will serve to prevent rotation of the backstop 30 with respect to the rest of the assembly.

The armature 50 with the print wire 55 attached thereto is then inserted through the bore 17 in the leg portion 15 and into the cylinder 20 to a normal rest position, illustrated in FIG. 1, wherein the piston portion 53 bears against the end surface 31 of the backstop 30. In this position, the print wire 55 projects forwardly well beyond the leg portion 15. The spring seat 60 is then inserted over the distal end of the print wire 55 until the end surface 63 bears against the piston portion 52 of the armature 50. The spring 65 is then seated on the spring seat 60 and, finally the nozzle 40 is fitted over the distal end of the print wire 55 and inserted in the cylinder 20 through the frame bore 17, until the annular shoulder 43 bears against the adjacent end of the cylinder 20. The outer surface of the leg portion 15 may then be deformed by suitable means to form radially inwardly extending stake 71 which projects over the outer surface of the nozzle 40 securely to hold it in place and to maintain the print wire actuator 10 in its assembled condition. In this condition, it will be appreciated that the spring 65 resiliently urges the armature 50 rearwardly to its normal rest position and resiliently accommodates movement of the armature 50 axially forwardly from that rest position for driving the print wire 55 in a well known manner toward the record medium 80.

It is a significant aspect of the present invention that the print wire actuator 10 is of relatively simple and economical construction. The prior art solenoid-type actuator, exemplified by the device disclosed in the aforementioned U.S. Pat. No. 3,755,700, created a gap in the cylinder by forming it in two separate parts and interposing between those parts an annular ring of magnetically impermeable material to afford the effect of an air gap while maintaining the structural integrity of the bobbin. But this arrangement resulted in a threepiece bobbin construction, utilizing dissimilar materials and, therefor, necessarily complicated the construction of the cylinder. It is an important aspect of the present invention that the cylinder is formed unitarily of a single piece of magnetically permeable material. In order to provide the effect of an air gap, a control groove 26 is formed in the outer surface 23 of the cylinder. The resulting thin control annulus 29, acting as a magnetic flux control portion, has a cross sectional area which is reduced sufficiently, in comparison to the cross sectional area of the rest of the cylindrical body 21, to cause the material to go into magnetic saturation locally in the region of the control annulus 29 when the coil 70 is energized. When saturation occurs, the material then behaves in the same manner as an air gap. Thus, there is provided a cylinder which can be economically formed of a single piece of magnetically permeable material, but which has the same magnetic performance as the threepiece cylinder of the prior art device.

But an additional aspect of the present invention is the provision of a print wire actuator of significantly reduced size. The armature, as the innermost portion of the solenoid-type actuator, governs the overall diameter of the device. But it has been found that attempts to reduce the diameter of the armature in the prior devices has resulted in a square law reduction in the drive force imparted to the print wire, which resulted in unacceptable performance. The present invention overcomes this difficulty by providing an armature 50 with multiple axially-spacedapart piston portions 52 and 53 thereon. In a preferred embodiment of the invention two such piston portions 52 and 53 are provided on the armature 50, although it will be appreciated that any desired number of piston portions could theoretically be employed, subject to the force, speed and mass desired for the particular application and the degree of complexity of the armature construction which would be acceptable.

More particularly, it has been found that each of the piston portions 52 and 53 acts as a separate armature, these two piston portions being connected in tandem so that the magnetic forces being imparted thereto are additive. Since two piston portions 52 and 53 have been provided, there have correspondingly been provided two of the control grooves 26 in the cylinder 20, respectively positioned adjacent to the leading edges of the piston portions 52 and 53 in the normal rest position of the armature 50. Thus, the piston portions 52 and 53 of the armature 50 cooperate with the cylinder 20 and the frame 11 to complete a magnetic circuit providing a path for magnetic flux, with the piston portions 52 and 53 respectively providing paths past the effective gaps formed by the control grooves 26. Thus, when the coil 70 is energized, the position of the parts is such that the axial components of the magnetic forces exerted on the piston portions 52 and 53 drive the armature 50 forwardly (to the right, as viewed in FIG. 1), for driving the print wire 55 against the associated printing medium. The armature 50 moves toward an equilibrium printing position (not shown) wherein the piston portions 52 and 53 respectively are disposed substantially symmetrically with respect to the control grooves 26, i.e., each piston portion projects substantially equal distances forwardly and rearwardly of the associated control groove 26. In this equilibrium position, the axial components of the magnetic forces exerted on the piston portions 52 and 53 balance out or should be zero. In printing, the pistons are designed not to reach the equilibrium position by the interposition of the record medium. When the coil 70 is de-energized, the armature 50 is returned to its normal rest position under the urging of the compression spring 65 and the rebounding of the piston and wire mass from the target.

Because of the doubling of the magnetic force obtained by providing two piston portions 52 and 53, the overall diameter of the piston portions 52 and 53 can be reduced by a factor of the square root of two while maintaining the same overall impact force originally obtained with a larger single-piston armature. Specifically, it has been found that the same impact force can be achieved, without altering the mass or acceleration of the armature 50, by providing piston portions 52 and 53 having a diameter of approximately 0.7 of the diameter of a corresponding single-piston armature. Thus the overall diameter of the bobbin 20 and the coil 70 can be correspondingly reduced without reduction of the drive force imparted to the print wire 55.

It is another significant aspect of this invention that the reduction in overall size of the print wire actuator 10 is facilitated by the unique construction of the frame 11. More specifically, in the prior solenoidtype actuators, the entire device was enclosed within a cylindrical housing, the thickness of the walls of which increased the lateral space occupied by the device. The frame 11, on the other hand, is open sided, thereby permitting a plurality of print wire actuators 10 to be arranged more closely together, occupying less overall space. In this regard, the base plate 12 and the bracket 13 have been designed with sufficient cross-sectional area to offset the material loss occasioned by the open sides, so as to maintain the proper operation of the magnetic circuit.

In one embodiment of the present invention, the frame 11, the cylinder 20 and the armature 50 are all formed of magnetically permeable material, such as suitable steels, while the backstop 30, the nozzle 40 and the spring seat 60 are all formed of non-magnetic materials, such as suitable plastic materials. With the use of the present invention there can be provided a high speed, low energy solenoid-type printer actuator which has sufficient impact force capability to print six-part paper in a 600 line per minute printer application with a minimum of complexity and overall size.

While in the embodiment shown in FIG. 1, the coil 70 was wound on cylinder 20, ease of manufacture of the actuator was improved by winding the coil on a cylindrical plastic bobbin which was placed over the cylinder 20. Applicants further have determined that improved manufacturability and flux control is achieved by shaping the frustro conical end walls 28 of the grooves 26 to have a step 84 leading to the inner wall 27. The step arrangement permits precise location of the air gap effect at the leading edges of their associated pistons. It also concentrates the magnetic flux between the leading edges of the pistons and the right hand edge of the associated annulus 29 thereby maximizing the drive force for the print wire 55.

What we claim as new and desire to secure by Letters Patent of the United States is:

1. A solenoid-type print wire actuator for use in a dot-matrix printer, said actuator comprising:

a one-piece magnetically permeable cylinder member having an internal cylindrical aperture and forming part of an annular magnetic circuit along its axial direction;

said one-piece cylinder member having a plurality of spaced-apart annular grooves formed into its external surface so as to provide a corresponding plurality of magnetically saturable annular gaps in the magnetic circuit;

an electrical drive coil means electromagnetically linked to said magnetic circuit;

a one-piece magnetically permeable armature member having a similar plurality of spaced-apart cylindrical piston portions slidingly fitted into the internal cylindrical aperture of the one-piece cylinder member, each said piston portion progressively magnetically bridging a respectfully corresponding one of said gaps as said armature member is axially moved in a dot-printing action; and spring biasing means exerting a spring bias force on said armature member to position it, in the absence of an electromagnetic driving force from said drive coil means, to a nominal rest position whereat said piston portions partially bridge said gaps.

2. A solenoid-type print wire actuator as in claim 1 further comprising:

an elongated dot print wire means rigidly affixed directly to one axial end of said armature member.

3. A solenoid-type print wire actuator as in claim 1 wherein said piston portions and said annular grooves are each equally spaced apart by the same dimension.

4. A solenoid-type print wire actuator as in claim 1 wherein said annular grooves include opposed frustoconical portions in end walls thereof.

5. A solenoid-type print wire actuator as in claim 1 wherein said annular grooves include opposed radially stepped portions in end walls thereof.

6. A solenoid-type print wire actuator as in claim 4 wherein said annular grooves include opposed radially stepped portions in end walls thereof.

7. A solenoid-type print wire actuator as in claim 1 wherein said spring biasing means comprises:

a backstop member disposed with the one piece cylinder at a first axial end of said armature to define its minimum spacing from one end of the cylinder member;

a helically coiled spring;

a spring seat disposed at the second axial end of said armature and on which one end of said spring is seated; and a spring retaining and seating means disposed at the other end of said spring and rigidly affixed with respect to the other end of said cylinder to compress said spring and thus bias said armature towards contact with said backstop member.

8. A solenoid-type print wire actuator as in claim 1 further comprising a cylindrical bobbin surrounding said cylinder member on which said drive coil means is wound.

9. A solenoid-type print wire actuator for use in a dot-matrix printer, said actuator comprising:

a one-piece magnetically permeable frame member bent into a U-shaped bracket having a bight portion disposed between two substantially parallel rectangular leg portions depending therefrom;

at least one of said leg portions having an aperture therein;

a one-piece magnetically permeable cylinder member retained between said leg portions and having an internal cylindrical aperture aligned with said aperture in the leg portions to form an annular magnetic circuit along its axial direction which is at least partially completed through said frame member;

said one-piece cylinder member having a plurality of spaced-apart annular grooves formed into its external surface so as to provide a corresponding plurality of magnetically saturable annular gaps in the magnetic circuit;

an electrical drive coil means electromagnetically linked to said magnetic circuit;

a one-piece magnetically permeable armature member having a similar plurality of spaced apart cylindrical piston portions slidingly fitted into the internal cylindrical aperture of the one-piece cylinder member, each said piston portion progressively magnetically bridging a respectively corresponding one of said gaps as said armature member is axially moved toward said aperture in the leg portions, said movement corresponding to a dot-printing action; and spring biasing means exerting a spring bias force on said armature member to position it, in the absence of an electromagnetic driving force from said drive coil means, to a nominal rest position whereat said piston portions partially bridge said gaps.

10. A solenoid-type print wire actuator as in claim 9 further comprising:

an elongated dot print wire means rigidly affixed directly to one axial end of said armature member and extending axially through said aperture in said leg portions.

11. A solenoid-type print wire actuator as in claim 9 wherein said piston portions and said annular grooves are each equally spaced apart by the same dimension.

12. A solenoid-type print wire actuator as in claim 9 wherein said annular grooves include opposed frustoconical portions in end walls thereof.

13. A solenoid-type print wire actuator as in claim 9 wherein said annular grooves include opposed radially stepped portions in end walls thereof.

14. A solenoid-type print wire actuator as in claim 12 wherein said annular grooves include opposed radially stepped portions in end walls thereof.

15. A solenoid-type print wire actuator as in claim 9 wherein said spring biasing means comprises:

a backstop member disposed with the one piece cylinder at a first axial end of said armature to define its minimum spacing from the adjacent leg portion of the frame member;

a helically coiled spring;

a spring seat disposed at the second axial end of said armature and on which one end of said spring is seated; and a spring retaining and seating means disposed at the other end of said spring and rigidly affixed with respect to said frame and cylinder members to compress said spring and thus bias said armature towards contact with said backstop member.

16. A solenoid-type print wire actuator as in claim 9 further comprising:

a cylindrical bobbin surrounding said cylinder member on which said drive coil means is wound.

* * * * *